United States Patent [19]

Numata et al.

[11] Patent Number: 4,468,537

[45] Date of Patent: Aug. 28, 1984

[54] SOUND SYSTEM HAVING SUPPRESSION OF AM STEREOPHONIC RECEIVING CIRCUIT-INDUCED NOISE

[75] Inventors: Tatsuo Numata; Akira Nishioka; Hitoshi Hirata, all of Tokyo, Japan

[73] Assignee: Pioneer Electronic Corporation, Tokyo, Japan

[21] Appl. No.: 274,613

[22] Filed: Jun. 17, 1981

[30] Foreign Application Priority Data

Jun. 19, 1980 [JP] Japan ..... 55-83154

[51] Int. Cl.[3] ..... H04H 5/00

[52] U.S. Cl. ..... 381/15; 381/94

[58] Field of Search ..... 179/1 GJ, 1 GM, 1 GS, 179/1 P; 455/296, 308–312

[56] References Cited

U.S. PATENT DOCUMENTS 3,167,614 1/1965 Holt et al. ..... 179/1 GS
3,296,378 1/1967 Fish et al. ..... 179/1 GM
3,378,773 4/1968 Jeffers ..... 179/1 GS
3,792,199 2/1974 Saeki ..... 179/1 GM
4,030,036 6/1977 Kusano ..... 179/1 GM
4,215,316 7/1980 Yamaguchi et al. ..... 179/1 GS

*Primary Examiner*—A. D. Pellinen
*Attorney, Agent, or Firm*—Sughrue, Mion, Zinn, Macpeak, and Seas

[57] ABSTRACT

A multi-function sound system including an AM stereophonic receiving function in which interference with operating circuits in modes other than the AM stereophonic mode is eliminated. A limiter receives a IF AM stereophonic received signal and removes the amplitude variation components therefrom and couples the resulting signal to a phase detector composed of a phase-locked loop which produces as an output signal a sub-signal. A switch is provided which deactivates both the limiter and the voltage-controlled oscillator in the phase-locked loop circuit when the sound system is set to other than the AM stereophonic receiving mode.

6 Claims, 2 Drawing Figures

SOUND SYSTEM HAVING SUPPRESSION OF AM STEREOPHONIC RECEIVING CIRCUIT-INDUCED NOISE

BACKGROUND OF THE INVENTION

The present invention relates to a multi-function sound system having an AM stereophonic receiving function. More particularly, the invention relates to a multi-function sound system which incorporates an AM-PM stereophonic type AM receiving function and other functions such as an FM receiving function and the like.

In an AM-PM type AM stereophonic broadcasting system, an AM stereophonic signal is transmitted in which a carrier signal is phase modulated by a sub signal and amplitude modulated by a main signal. There has been previously disclosed an AM-PM type AM stereophonic receiving system in which the envelope of a received signal of this type is amplitude detected to thereby obtain a main signal output, amplitude variation components of the received signal are removed by a limiter having an amplifying function, and then the resulting signal is phase detected with a phase-locked loop (PLL) circuit to thereby obtain a sub signal output. The main and sub signals are combined in a matrix circuit so as to obtain right and left channel signal outputs.

There has also been disclosed a so-called multi-function sound system which incorporates such an AM stereophonic receiving function and other operating functions such as, for example, an FM receiving function, a record disc reproducing function, and the like. When the multi-function sound system is, however, switched to a function other than the AM stereophonic receiving mode, problems occur. Specifically, since the limiter in the AM stereophonic receiver section has a large amplification factor and produces a substantially rectangular pulse signal, if a small level of noise is introduced into the input of the limiter, the limiter produces a high level pulse which adversely affects other circuits such as by induction or radiation. In addition, the free-running oscillator output from the voltage-controlled oscillator (VCO) in the PLL may also radiate to other circuits.

SUMMARY OF THE INVENTION

It is thus an object of the present invention to provide a multi-function sound system which eliminates radiation from the AM stereophonic receiver circuit except when an AM stereophonic signal is being received.

In order to accomplish the above and other objects, there is provided, according to one aspect of the invention, a multi-function sound system in which a limiter in an AM stereophonic receiver section is deactivated except when an AM stereophonic signal is being received. Also the oscillation of the VCO in the PLL circuit used for detecting a sub signal is stopped.

DESCRIPTION OF THE PREFERRED EMBODIMENTS

A preferred embodiment of the present invention will be described with reference to the drawings.

Figure 1:
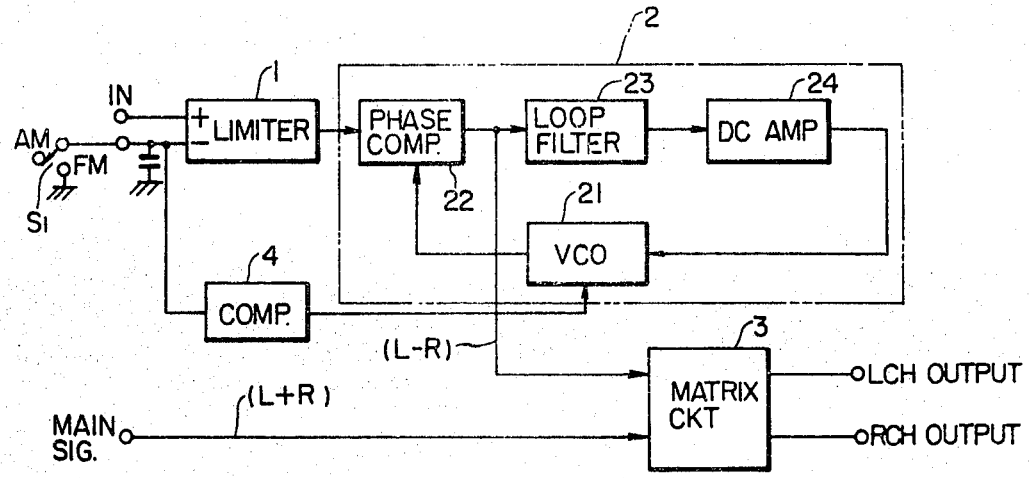
FIG. 1 is a block diagram of a preferred embodiment of a sound system to which the invention is applied.

FIG. 1 shows in a block diagram a preferred embodiment of a multi-function sound system of the present invention. An AM-PM stereophonic signal is received and converted to an IF signal which is applied to a non-inverting input of a limiter 1 which is formed with a differential amplifier. The limiter 1 serves to amplify and limit the amplitude of the AM-PM stereophonic signal thus applied and to remove the amplitude variation components of the AM-PM stereophonic signal. The rectangular signal output from the limiter 1 is in turn applied to a PLL circuit 2 which phase detects a sub signal.

The PLL circuit 2 includes a 90° phase comparator 22 which compares the phase of the output from the limiter 1 with the output from a VCO 21, a loop filter 23 which converts the compared output from the phase comparator 22 into a DC voltage output, and a DC amplifier 24 which amplifies the DC voltage output from the loop filter 23 and controls the VCO 21.

The phase modulated component of the AM stereophonic signal is produced by the phase comparator 22 as a sub signal (L−R). On the other hand, a main signal (L+R) is detected by an envelope detector (not shown) which detects the amplitude variation components of the IF signal in a known manner. The main signal is applied to one input terminal of a matrix circuit 3 while the sub signal produced by the phase comparator 22 is applied to the other input terminal of the matrix circuit 3. The matrix circuit 3 mixes both the main signal and the sub signal and produces right and left channel output signals.

A function switch $S_1$ which is used to switch between AM and FM receiving modes is further connected to the inverting phase input terminal of the limiter 1. The function switch $S_1$ operates to connect the inverting input terminal of the limiter to ground potential except when receiving an AM signal. The ground potential of the function switch $S_1$ is applied through the common terminal of the switch $S_1$ to the input of a comparator 4. The output from the comparator 4 is sequentially applied as an oscillation stop signal to the other input of the VCO 21 for stopping the oscillation of the VCO 21.

When the function switch $S_1$ is switched to the AM stereophonic signal receiving position, the DC balance of the differential input to the limiter 1 remains normal and hence the limiter 1 operates normally. When the function switch $S_1$ is switched, for example, to the FM stereophonic signal receiving position, or any position except for the AM stereophonic signal receiving position, the inverting input of the limiter 1 is grounded. This causes a DC imbalance in the differential input to the limiter 1 which in turn stops the amplifying and limiting operations of the limiter 1. Simultaneously, the comparator 4 produces a high level output signal due to the grounding of the input terminal of the comparator 4 and applies the high level output signal to the VCO 21 to stop the operation of the VCO 21. Accordingly, this eliminates the transmission of noise to the limiter 1 and unwanted radiation caused by the oscillation of the VCO 21.

Figure 2:
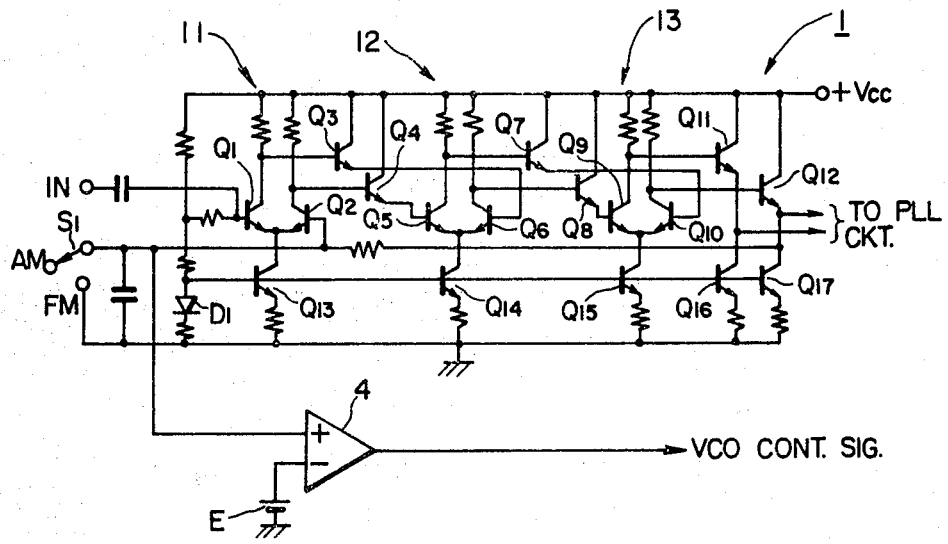
FIG. 2 is a circuit diagram showing a specific example of essential parts of the sound system shown in FIG. 1.

FIG. 2 shows circuit diagram of the limiter 1 and the comparator 4 and the function switch $S_1$, wherein like reference numerals designate the same components as in FIG. 1. The limiter 1 includes three differential amplifiers 11, 12 and 13 coupled in a cascade arrangement, the respective amplifiers 11, 12 and 13 including differential transistor pairs $Q_1$ and $Q_2$, $Q_5$ and $Q_6$, and $Q_8$ and $Q_{10}$. The differential amplifiers 11, 12 and 13 respectively produce differential output signals through emitter follower transistor pairs $Q_3$ and $Q_4$, $Q_7$ and $Q_8$, and $Q_{11}$ and $Q_{12}$. Transistors $Q_{13}$, $Q_{14}$, $Q_{15}$, $Q_{16}$ and $Q_{17}$ as well as a diode $D_1$ and related components form a current source for the respective differential amplifiers.

The output of the function switch $S_1$ on its common terminal is applied to the base of the differential transistor $Q_2$ to thereby control the base potential of the transistor $Q_2$. The output of the function switch $S_1$ on its common terminal is also applied to the non-inverting phase input of the comparator 4 to thereby control the comparator 4 which thus compares the output signal from the function switch $S_1$ with the reference voltage E and produces a VCO control voltage.

It may be appreciated from the foregoing description that since in the multi-function sound system of the invention unwanted radiation form the AM stereophonic signal receiver circuit to the other circuits is suppressed using an extremely simple configuration, a multi-functional sound system is provided which has excellent characteristics.

What is claimed is:

1. A multi-function sound system adapted for receiving AM stereophonic broadcast signals of a type in which a carrier is phase-modulated with a sub-signal and amplitude modulated with a main signal, comprising: a limiter for removing amplitude variation components of a received AM stereophonic signal, a received signal being coupled to an input of said limiter; phase detection means for detecting said sub-signal from an output of said limiter; and means for controlling said limiter to deactivate said limiter in operational modes other than an AM stereophonic receiving mode.

2. The sound system of claim 1 wherein said phase detection means comprises a phase-locked loop including a voltage-controlled oscillator; and wherein said control means further comprises means for deactivating said voltage-controlled oscillator except in said AM stereophonic receiving mode.

3. The sound system of claim 1 wherein said limiter has inverting and non-inverting inputs, a IF AM received signal being applied to said non-inverting input; and wherein said control means comprises a switch having one terminal coupled to said inverting input and a second terminal coupled to ground, wherein said inverting input is grounded other than in said AM stereophonic receiving mode.

4. The sound system of claim 3 wherein said means for deactivating said voltage-controlled oscillator comprises a voltage comparator having a first comparison input coupled to said inverting input of said limiter and a second comparison input coupled to a reference voltage source.

5. The sound system of claim 2 wherein said limiter comprises first through third differential amplifiers coupled to cascade and emitter-follower amplifier transistors coupled to outputs of said third differential amplifier for producing output signals from said limiter.

6. The sound system of claim 2 wherein said limiter comprises first through third differential transistor pairs coupled in cascade with emitter-follower coupled transistors forming coupling elements between cascade-connected emitter follower transistor pairs; first through third current source transistors for supplying substantially constant currents to said first through third differential transistor pairs, respectively; and first and second output transistors coupled in emitter-follower configuration receiving input signals from outputs of said third differential transistor pair.

* * * * *